US005611326A

United States Patent [19]

Caspani et al.

[11] Patent Number: 5,611,326

[45] Date of Patent: Mar. 18, 1997

[54] DIAMOND-SET INSERT CARRIER TOOL FOR AUTOMATIC AND MANUAL MACHINES OF DRESSING, SMOOTHING AND POLISHING TYPE FOR THE STONE, CERAMIC AND TILE INDUSTRIES

[75] Inventors: Marco Caspani; Italo Garavaldi, both of Reggio Emilia, Italy

[73] Assignee: S.E.A. Utensili Diamantati S.p.A., Cadelbosco Sopra, Italy

[21] Appl. No.: 493,828

[22] Filed: Jun. 22, 1995

[30] Foreign Application Priority Data

Jun. 29, 1994 [IT] Italy ..... MI94A1350

[51] Int. Cl.[6] ..... B28D 1/00

[52] U.S. Cl. ..... 125/39; 451/540

[58] Field of Search ..... 451/540, 539, 451/527, 526, 548, 530, 552, 550, 541, 542, 41; 125/39

[56] References Cited

U.S. PATENT DOCUMENTS

| | | | |
|---|---|---|---|
| 2,225,193 | 12/1940 | Benner | 451/542 |
| 5,129,191 | 7/1992 | Warner et al. . | |
| 5,247,765 | 9/1993 | Quitana . | |

FOREIGN PATENT DOCUMENTS

| | | | |
|---|---|---|---|
| 0138237 | 4/1985 | European Pat. Off. . | |
| 8706303 | 6/1987 | Germany . | |
| 0266621 | 3/1970 | U.S.S.R. | 451/548 |
| 2246970 | 2/1992 | United Kingdom | 451/540 |
| WO9426470 | 11/1994 | WIPO . | |

OTHER PUBLICATIONS

Derwent Accession No. 94–160705, English Abstract of EP 597723, May 1994.

Derwent Accession No. 84–221021, English Abstract of FR 2,540,025, Aug. 1984.

*Primary Examiner*—Robert A. Rose

[57] ABSTRACT

A diamond-set insert carrier tool for dressing, chamfering, smoothing or polishing machines which comprises a body or support of thermoplastic material, in the active surface of which there are provided cavities able to receive diamond-set abrasive inserts or bodies and retain them substantially flush with said active surface by interference, said interference being between 0.1 and 0.3 min.

5 Claims, 2 Drawing Sheets

DIAMOND-SET INSERT CARRIER TOOL FOR AUTOMATIC AND MANUAL MACHINES OF DRESSING, SMOOTHING AND POLISHING TYPE FOR THE STONE, CERAMIC AND TILE INDUSTRIES

This invention relates to the finishing of the surface and edges of natural stone slabs, concrete articles, ceramics, tiles, conglomerates with natural stone inserts and synthetic or natural resin binders, etc.

It specifically relates to the last stage in the machining of these products, namely dressing, smoothing, squaring, chamfering and polishing.

These operations are normally carried out by machines provided with a planet head or oscillating heads, or even simple fixed arbors.

The invention relates to the tools to which diamond-set abrasive bodies are applied, and which are used on said machines.

Said tools must possess certain essential characteristics, such as absolute indeformability and extremely secure fixing of the diamond-set abrasive bodies.

For these reasons the diamond-set abrasive bodies are mounted on metal support tools of steel or composite material (aluminium and steel), to the outer surface of which the diamond-set abrasive bodies are fixed by brazing, ie that process by which the metal pieces are continuously joined together by infiltration of low melting-point support metal between the superposed surfaces of the pieces to be joined together, the material melting by heating the surfaces.

The brazing alloy is generally formed from silver and cadmium.

These tool types have however the drawback that when the diamond-set abrasive bodies mounted on them have worn down, the support has to be returned to the supplier to be ground and to receive new inserts.

A further drawback is their weight, which considerably affects the head wear of the operating machines on which the tools are mounted, even if the expedient is used of at least partly constructing these tools (connection part) of light alloy.

Moreover, the brazing process does not ensure perfect coplanarity of the abrasive bodies, which have to be subsequently ground, resulting in a wastage of material, the relative cost and machining time.

As the brazing is based on silver and cadmium it is very costly and produces highly contaminating cadmium vapour.

For the aforesaid reasons, numerous attempts have been made to construct diamond-set tools with a synthetic body.

European patent application EP 0597723-A1 describes a tool in which abrasive bodies are fixed on a steel plate, each comprising a flat base of thermoplastic polymer on which there is an abrasive part of thermoplastic polymer impregnated with abrasive particles.

The abrasive part is fixed to the base by projections inserted as an interference fit into corresponding cavities.

French patent application FR-2540025-A1 illustrates a rotary tool having a plastics body comprising cavities into which abrasive bodies are fixed.

The abrasive bodies are retained in the cavities by providing a plate at the base of the abrasive bodies, which projects beyond their lateral edge to form an under-surface insertion fixing which prevents the abrasive bodies from escaping from the cavities.

U.S. Pat. No. 5,247,765 illustrates a toot in which the abrasive bodies are embedded in a resin disc fixed to a metal support.

The tools of known type have the common drawback of precarious abrasive body fixing and a shape instability which prejudices their efficiency.

In order to preserve their shape they are provided with an interior metal part and require the abrasive bodies to be either embedded in the resin or provided with anchoring means.

A first object of the present invention is to provide a carrier tool for diamond-set inserts which is sufficiently rigid, which carries the inserts in a securely fixed manner and which, once used, can be disposed of.

A second object is to provide an extremely light support.

A third object is to provide inserts which do not require brazing or special fixing means.

A fourth object is to provide a complete tool, consisting of the support with mounted diamond-set abrasive bodies, which does not require final finishing by grinding.

Said objects are attained, according to the invention, by a tool in which the body or support is formed from thermoplastic resin of high mechanical characteristics, its characteristics satisfying the following table:

Rockwell hardness 50–130 scale R
Ultimate elongation 4–300%
Modulus of elasticity in tension 3500–35,000 kg/cm$^2$
Modulus of elasticity in bending 5000–80,000 kg/cm$^2$
Breaking strength at 23° C.:
under tension 150–950 kg/cm$^2$
under compression 80–800 kg/cm$^2$
under bending 120–2100 kg/cm$^2$ Teflon, ABS, PVC and Nylon 6 satisfy these standards, for example.

The body or support is formed by moulding in a suitable mould or by mechanical machining, the generally cylindrical seats for receiving the abrasive bodies being formed in it by mechanical machining.

The abrasive bodies are forced into the seats, where they are securely retained by an interference fit.

An interference of 0.1–0.3 mm has proved convenient. Generally an interference of 0.2 mm is the most suitable. Interferences less than 0.15 mm or greater than 0.25 mm sometimes result in either imperfect fixing of the abrasive body or deformation of the support. In the first case the use of cyanoacrylate adhesives, such as the well known LOCTITE 601, conveniently solves the problem.

The abrasive bodies are completely inserted into the body, flush with the surface thereof.

The cylindrical shape is preferred for the ease with which it can be obtained on a chip-removing machine tool, however this is not critical for the invention.

With this system, that part of the support in contact with the material to be ground becomes worn simultaneously with the abrasive bodies contained in it, it having been found that the abrasive bodies become completely worn, with abrasive body residues practically non-existent.

The invention will be more apparent from the description of one embodiment thereof given by way of non-limiting example with reference to the two accompanying drawings, in which FIG. 1 is a plan view from below of a diamond-set polishing tool of the type comprising several oscillating heads;

FIGS. 1, 2 and 3 show a diamond-set insert carrier tool according to the invention for polishing machines comprising oscillating heads 1.

It is formed as a body produced in one piece by known methods from thermoplastic material known as Nylon 6 having the following characteristics:

| | |
|---|---|
| density | 1.13 g/cm$^3$ |
| melting point | 225° C. |
| temperature of utilization | 115–150° C. |
| distortion load and temperature | 18.5 kg/cm$^2$ at 70° C. |
| " | 4.6 kg/cm2 at 160° C. |
| coefficient of thermal expansion (linear) | 80 × 10$^{-6}$ mm/°C. |
| Rockwell hardness | 110 R |
| ultimate elongation | 150% |
| modulus of elasticity in tension | 13,000 kg/cm$^2$ |
| modulus of elasticity in bending | 26,000 kg/cm$^2$ |
| breaking strength under tension | 720 kg/cm$^2$ |
| breaking strength under compression | 800 kg/cm$^2$ |
| breaking strength under bending | 950 kg/cm$^2$ |
| dynamic coefficient of friction | 0.28 (dry steel) |
| static coefficient of friction | 0.30 (dry steel) |

The side 2 or active surface of the support to which the abrasive bodies are to be applied is shaped as an arc of a circle, the side 3 for connection to the machine being of dovetail shape, and more precisely as a Flickert arrangement.

Figure 2:
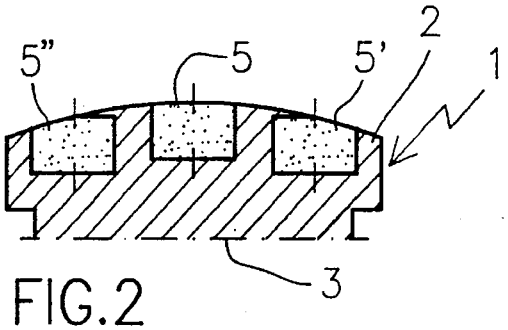
FIG. 2 is a section on the line II—II of FIG. 1 showing a first arrangement.
Figure 1:
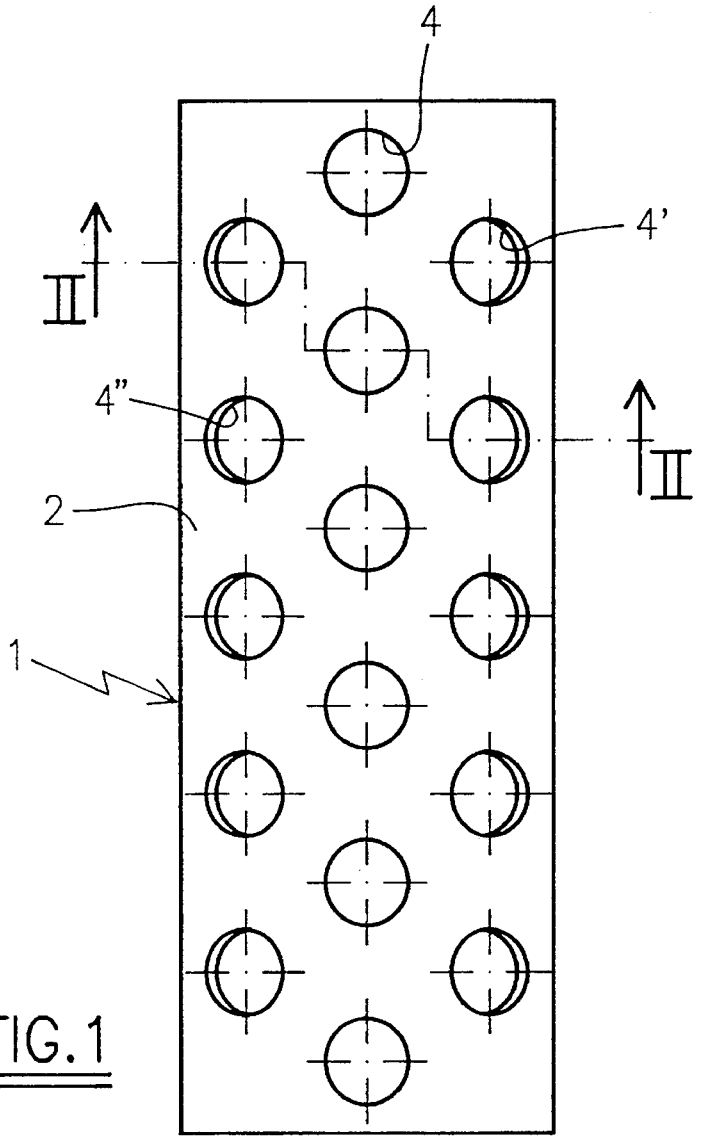

With reference to FIGS. 1 and 2 three rows of recesses 4, 4' and 4" are provided in the surface of the side 2 in a suitable known arrangement, all perpendicular to the central axis of the support.

These recesses are of circular cross-section. However as stated, they can be of the most varied cross-section such as parallelepiped, polygonal, oval etc.

The recesses house a like number of diamond-set abrasive bodies 5, 5", 5" etc. of corresponding shape.

The recesses have a depth equal to the abrasive body thickness and a lateral dimension slightly less than the lateral dimension of the inserts which they are to receive, in order to ensure an interference of 0.2 mm.

As the base of the carrier tool is shaped as an arc of a circle in order to allow oscillation during machining, abrasive bodies slightly chamfered on one side are inserted into the lateral rows so that when they are mounted they follow the curvature of the abrasive body carrier tool.

Figure 3:
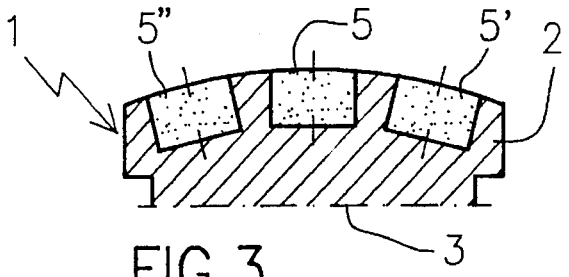
FIG. 3 is a section on the line II—II of FIG. 1 showing a second arrangement.

The modification of FIG. 3 shows a second arrangement in which the lateral support recesses are arranged with their axis inclined in accordance with the radius of curvature of the tool, hence allowing the use of abrasive bodies 5, 5', 5" without a chamfer.

To insert the abrasive bodies into the carrier tool of the invention, they are rested on the recesses and a pressure exerted on them by a suitable known fly press, arbor press etc. so as to force them into their respective housings, where they remain locked by simple interference between the outer walls of the recesses—of slightly lesser dimension—and the outer walls of the abrasive bodies.

Of the two arrangements shown in FIG. 2 and FIG. 3 the first has the advantage that the abrasive bodies can be pressed into the recesses all together, however laterally chamfered inserts must be used. The second has the advantage of using identical inserts, however the pressing must be done for individual rows, varying the tool inclination from one row to the next.

Figure 5:
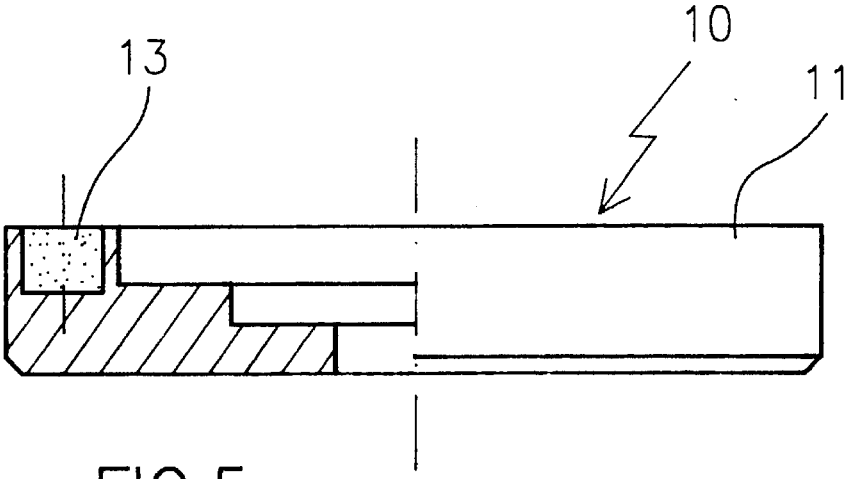
FIG. 5 is a section on the line VV of FIG. 4.
Figure 4:
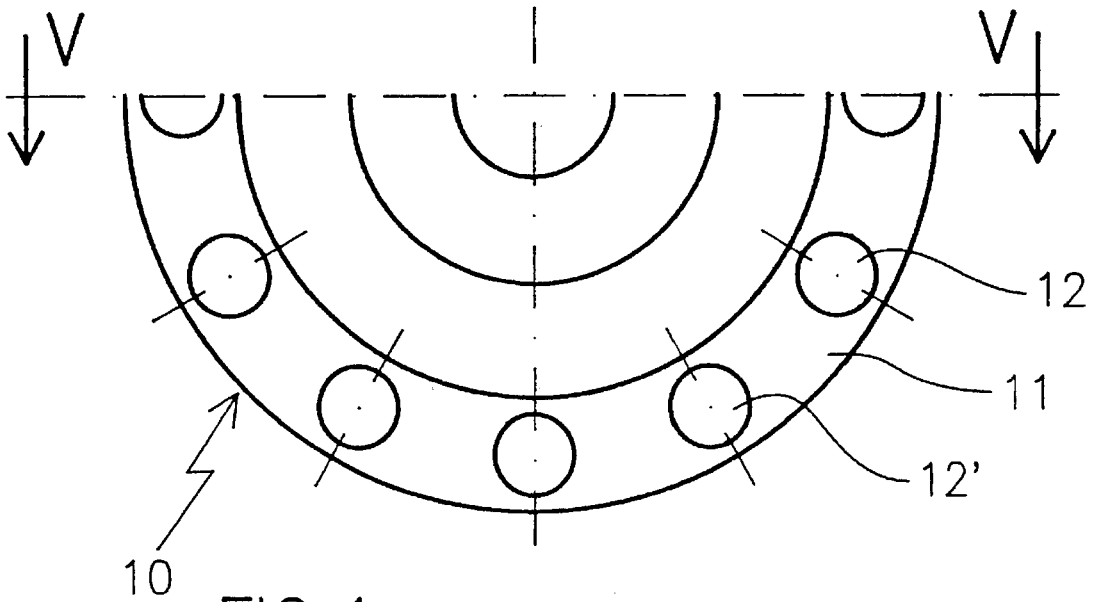
FIG. 4 is a view of a diamond-set polishing tool of the planet head type.

With reference to FIGS. 4 and 5, the tool for planet heads 10 consists substantially of a circular disc 11, the outer ring of which is provided, as in the preceding case, with carrier recesses 12 for the diamond-set abrasive bodies, these recesses having the same dimension characteristics as the preceding case (depth equal to the abrasive body height, lateral dimensions slightly less), the diamond-set abrasive bodies being inserted into them as in the preceding case.

The invention has been described by way of non-limiting example and is subject to various modifications, such as one in which the abrasive bodies are fixed into the insert carrier tool by suitable adhesives compatible with the two contacting materials, while remaining within the scope of the invention.

We claim:

1. A diamond-set insert carrier tool for dressing, chamfering, smoothing or polishing machines, comprising a supporting body of a thermoplastic material having the following physical and mechanical characteristics:

Rockwell harness: 50–130 scale R;

Ultimate elongation: 4–300%;

Modulus of elasticity in tension: 3500–35,000 kg/cm$^2$;

Modulus of elasticity in bending: 5000–80,000 kg/cm$^2$;

Breaking strength at 23° C.:
under tension 150–950 kg/cm$^2$;

Breaking strength at 23° C.:
under compression 180–1800 kg/cm$^2$; and

Breaking strength at 23° C.:
under bending 120–2100 kg/cm$^2$;

in an active surface of which there are provided cavities able to receive diamond-set abrasive inserts and retain them substantially flush with said active surface by an interference-fit of between 0.1 and 0.3 mm.

2. A tool as claimed in claim 1, wherein if the interference is less than 0.15 mm the abrasive inserts are fixed with the aid of a cyanoacrylate adhesive.

3. A tool as claimed in claim 2, wherein the adhesive is LOCTITE 601.

4. A tool as claimed in claim 1, wherein the thermoplastic material is selected from the group consisting of PTFE, ABS, PVC, and polyamide.

5. A tool as claimed in claim 1, characterised in that the resin is polyamide, having the following characteristics:

| | |
|---|---|
| density | 1.13 g/cm$^3$ |
| melting point: | 225° C.; |
| temperature of utilization: | 115–150° C.; |
| distortion load and temperature: | 18.5 kg/cm$^2$ at 70° C.; |
| " | 4.6 kg/cm2 at 160° C.; |
| coefficient of thermal expansion (linear): | 80 × 10$^{-6}$ mm/°C.; |
| Rockwell hardness: | 110 R; |
| ultimate elongation: | 150%; |
| modulus of elasticity in tension: | 13,000 kg/cm$^2$; |
| modulus of elasticity in bending: | 26,000 kg/cm$^2$; |
| breaking strength under tension: | 720 kg/cm$^2$; |
| breaking strength under compression: | 800 kg/cm$^2$; |
| breaking strength under bending: | 950 kg/cm$^2$; |
| dynamic coefficient of friction: | 0.28 (dry steel); and |
| static coefficient of friction: | 0.30 (dry steel).-- |

* * * * *